United States Patent [19]

Ressi di Cervia

[11] Patent Number: 4,496,268

[45] Date of Patent: Jan. 29, 1985

[54] METHOD AND APPARATUS FOR CONSTRUCTING REINFORCED CONCRETE WALLS IN THE EARTH

[75] Inventor: Arturo L. Ressi di Cervia, New York, N.Y.

[73] Assignee: Finic, B.V., Rotterdam, Netherlands

[21] Appl. No.: 471,100

[22] Filed: Mar. 1, 1983

[51] Int. Cl.[3] ..... E02D 5/18; E21D 1/00; E21D 5/00

[52] U.S. Cl. ..... 405/133; 405/267; 405/268; 249/10

[58] Field of Search ..... 405/133, 134, 150, 151, 405/222, 233, 266–268; 249/1, 10, 11, 51; 52/169.13, 742

[56] References Cited

U.S. PATENT DOCUMENTS

| | | | |
|---|---|---|---|
| 2,329,223 | 9/1943 | Schmidt | 405/267 |
| 2,791,886 | 5/1957 | Veder | 405/267 |
| 3,100,381 | 8/1963 | Case et al. | 405/267 X |
| 3,293,865 | 12/1966 | Loofbourow et al. | 405/133 |
| 3,402,559 | 9/1968 | Fukushima | 405/222 |
| 3,464,665 | 9/1969 | Schoewert | 249/10 |
| 4,180,350 | 12/1979 | Watts | 405/267 X |

FOREIGN PATENT DOCUMENTS

| | | | |
|---|---|---|---|
| 2133081 | 2/1972 | Fed. Rep. of Germany | 405/267 |
| 155424 | 9/1982 | Japan | 405/267 |
| 6714858 | 5/1969 | Netherlands | 405/267 |
| 624989 | 9/1978 | U.S.S.R. | 405/267 |
| 950857 | 8/1982 | U.S.S.R. | 405/267 |

*Primary Examiner*—Dennis L. Taylor
*Assistant Examiner*—Nancy J. Stodola
*Attorney, Agent, or Firm*—Jim Zegeer

[57] ABSTRACT

Reinforced concrete walls, particularly circular shafts are constructed in difficult and rocky ground by casting a pair of guide walls spaced apart a distance larger than the nominal thickness of the final wall structure and the trench excavation for the wall is carried out between the two guide walls. Initially, backfilling is of a plastic erodable mixture such as cement-bentonite, sand-cement-bentonite, which have no large aggregates. At the surface above the guide walls, forms are set for casting the reinforced structures which are to form the concrete wall per se and hollow pipes are embedded in the structure at spaced intervals, each with pipe couplings extending out of the concrete, along with the vertical runs of the steel reinforcing bars, for the next succeeding section. Water is then injected into the pipes gradually washing the erodable backfill material and facilitating the descent of the cast concrete section, which is lowered by jacks anchored to the guide walls. The material of the backfill is washed out of alternate pipes (water is injected in one, soil and water exits from the next pipe). As the wall section is lowered, the next concrete wall section is formed and concreted in sequence. As each wall section is formed, the next pipe sections are coupled to the protruding sections and the next reinforcing elements are secured to the protruding reinforcing bars of the element that has been lowered. The sequence continues until the whole structure has reached the design depth, or a bearing stratum or rock. Finally, as the structure reaches the design depth, the pipes can be used as grout pipes to extend a drill curtain below the bottom, fill the contact between the structure and the rock and grout any voids left around the structure by washing of the backfill.

9 Claims, 5 Drawing Figures

FIG. 1
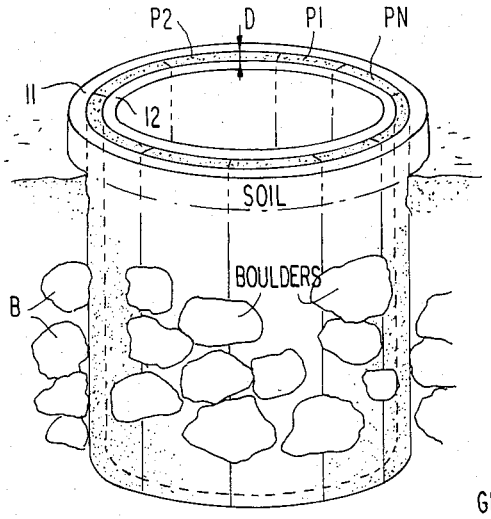
FIG. 2
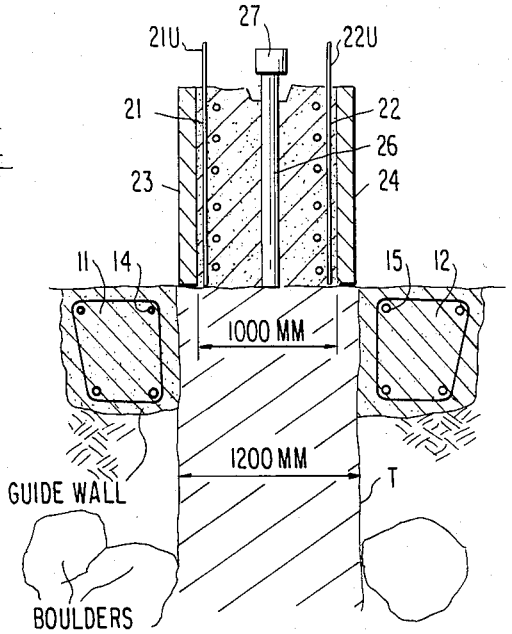
FIG. 3
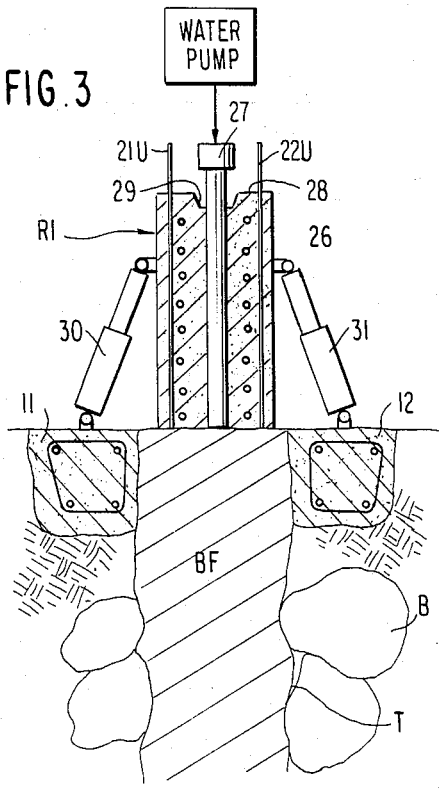
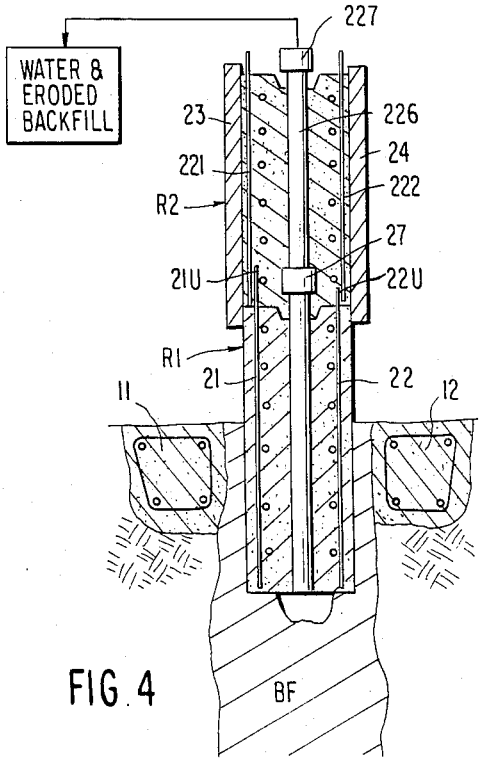
FIG. 4

METHOD AND APPARATUS FOR CONSTRUCTING REINFORCED CONCRETE WALLS IN THE EARTH

BACKGROUND OF THE INVENTION

Construction of shafts having smooth walls, particularly where the ground conditions are hard and rocky and where conventional slurry walls would be irregular and possibly misaligned, and in the presence of a high water table is difficult. The present invention utilizes the known slurry wall excavation techniques, combined with cement bentonite trench in sinking of caisons in a unique way for constructing reinforced concrete walls in difficult or rocky ground particularly with respect to the problem of sinking circular shafts when ground conditions are hard and in the presence of a high water level. The invention allows the construction of such a wall where continuity of horizontal reinforcement in the shaft is desired.

According to the invention, the system for sinking a large hollow shaft comprises forming two reinforced concrete guide walls spaced apart a distance larger than the nominal wall thickness of the final concrete structure. The excavation is then performed, preferably in panel sections with the backfil consisting essentially of erodable plastic mixtures such as cement-bentonite, sand-cement-bentonite or similar materials which have no large aggregates. A form supported on the guide walls is constructed over the slurry wall for segments of the final structure leaving embedded six inch pipes, for example, at one meter intervals with pipes coupling extending and ends of vertical reinforcement bars out of the poured concrete. As the forms for the section are removed above ground, hydraulic jacks are placed on the concrete element, segment or ring and are anchored to the guide walls. Then water is injected into alternate ones of the pipes, washing the erodable backfill and from beneath the hardened concrete and facilitating the descent of the toroidal section (in the case of a circular shaft) of the wall which is pull, supported or guided as need may be by jacks. As one section is lowered, the next is formed and concreted and the sequence continues until the whole structure has reached design depth, which may be a bearing stratum or rock. The material of the backfill is washed out of alternate ones of the pipes, so that as water is injected in one pipe, soil, water and bentonite e.g. the temporary backfill, exits from the next pipe. As the structure reaches design depth, the pipes may then all be used as grout pipes to extend a drill curtain below the bottom of the wall, seal the space between the structure and rock, and grout any void left around the structure by washing of backfill.

BRIEF DESCRIPTION OF THE DRAWINGS

The above and other objects, advantages and features of the invention will become more apparent when considered with the following specification taken with the accompanying drawings wherein:

FIG. 1 is a perspective view illustrating the construction of a wall with an erodable backfill mixture in accordance with the invention, FIG. 2 is a sectional view illustrating the forming of slurry walls with the steel reinforced concrete toroidal section with a system of pipes, typically six inch diameter pipes spaced at one meter intervals with the pipe coupling and vertical elements of the steel reinforcing bars extending above the poured concrete, FIG. 3 illustrates the use of jacks to lower the element or segment which has been cast above the ground into the trench as the water is injected into the pipes washing the erodable backfill material, FIG. 4 illustrates the construction of the toroidal ring in sections and the sequence according to the invention.

As shown in FIG. 1, a strong pair of spaced, steel reinforced, concrete guide walls 11 and 12 are constructed and spaced apart a distance D which is larger than the nominal thickness of the final concrete wall structure. In this preferred embodiment, the invention is illustrated as being applied to a circular shaft, but it will be appreciated that it can be applied to shafts of any cross sections such as rectangular, hexagonal, oval shafts and the like and, certain aspects of the invention can be applied to forming straight walls e.g. walls which do not close upon themselves and do not form shafts. Preferably, the excavation is carried out in sections so as to form panel sections and can be carried out using well known slurry excavation techniques as disclosed in Veder U.S. Pat. No. 3,310,952 and also disclosed in the text "3 The I.C.O.S. Company In The Underground Works" (1968), incorporated herein by reference.

Figure 5:
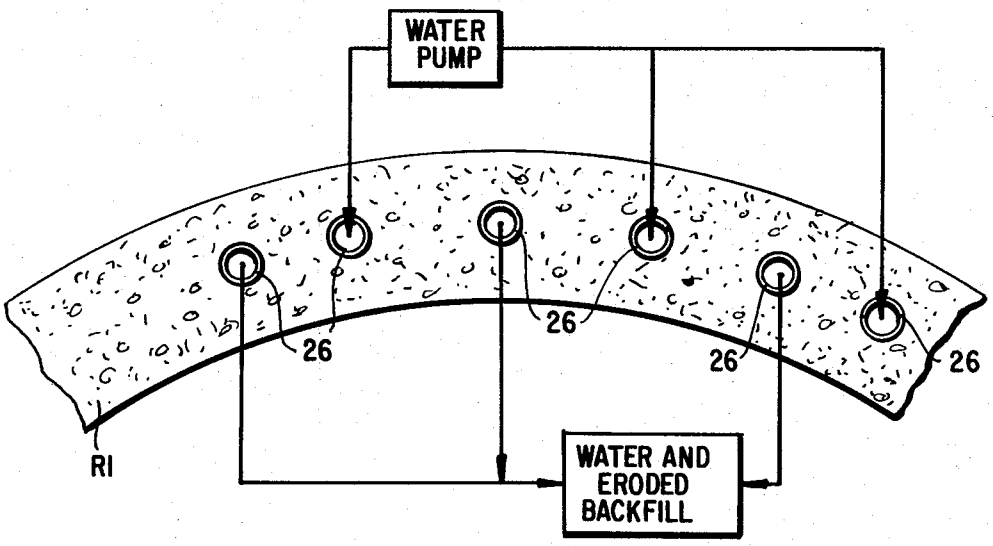
FIG. 5 is a top plan view showing the injection of water into the pipes for washing the erodable backfill material from the trench to lower the cast ring element R1.

Techniques that are especially useful in excavating in difficult soils where there are large boulders and the like are disclosed in the above noted patent and text. Chissels, rotary bits and the like may be used to excavate through the rock. In a preferred aspect of this portion of the invention, the slurry trench is excavated to the final depth. According to this aspect of the invention, the construction is done in panels and the backfill consists of a plastic erodable mixture with no large aggregates, such as a cement-bentonite mixture, sand-cement-bentonite or a similar backfill material. It is noted that the use of a pair of spaced apart concrete guide walls is not new, having been utilized by the assignee hereof for many years in constructing numerous steel reinforced concrete underground cut-off wall structures. That is to say, the structure illustrated in FIG. 1 and the manner of forming same is not per se deemed to be novel according to the present invention.

As shown in FIG. 2, the guide walls 11 and 12 are provided with steel reinforcements 14 and 15. The excavation of the trench T having a thickness or width D to the full depth of the wall and may be carried out by a number of slurry trench excavation techniques disclosed in the text "3 The I.C.O.S. Company In The Underground Works". In the present case, the excavation of trench T is formed in panel sections P1, P2, P3 . . . PN with the excavation in part being carried out by clam shells where the earth is amenable to clam shell bucket excavation and when the boulders and massive rock blocks are encountered, they are removed by chissels, rotary drills and the like, all of which are well known in the art.

In the present case, as each panel section P1, P2, P3 . . . PN is excavated, it is backfilled with a plastic erodable mixture such as cement-bentonite, sand-cement-bentonite or similar such backfill with no large aggregates. (In relatively shallow walls, the excavation can be done by a backhoe in a cement-bentonite slurry mixture so that the erodable backfill is in place as earth is excavated). After completion of the last panel wall section PN, an initial final concrete wall construction is constructed above the trench which is maintained full of the erodable plastic mixture. This is done by erecting steel reinforcement cages in the form of an annulus, and in FIG. 2, it is indicated by two annular rings 21, 22 which are cross connected by other steel reinforcing bars not shown. Annular forms 23, 24 are set up around the form and a series of pipes, in this case approximately six inches in diameter and embedded at about one meter intervals with a pipe coupling 27 extending out above the level of the concrete are provided. The lower edge of annular forms 23, 24 may be open so the concrete is cast on or initially interfaces with the erodable mixture. However, the lower edge of the initial casting forms can be closed with a metal plate or mesh so the first concrete ring is installed in the form with a mesh, not shown at the lower edges of initial casting which, in conjunction with the upper surface of the erodable backfill to permit the installation of the concrete in the form. It will be noted that the upper ends 21U and 22U of the vertical runs of the steel reinforcing cage 21 and 22 project above the level of the concrete with pipe coupling 27. As shown in FIG. 3, the upper edge 28 of the concrete is shaped so as to provide an annular trough or groove 29 so as to provide an interlocking joint or section when the next concrete element or annulus is cast.

As shown in FIG. 3, after the forms have been removed, hydraulic jacks 30, 31 are secured to the annular concrete ring R11, there being a plurality of such jacks spaced around the ring R1 and extending between the guide walls 11 and 12 and fastens to the external and internal surfaces of ring R1. It will be appreciated that conventional anchors or lifting rings are embedded in the concrete ring R1 and locked to the reinforcement cage 21, 22. as shown in FIG. 5, water is then injected into the alternate ones of pipes 26 and with the eroded portions of the erodable backfill withdrawn or exited from an adjacent pipe 26. As the upper layers of the erodable backfill material are removed, the jacks 30 and 31 lower the toroidal sections of the wall R1 into the trench T. After one toroidal section R1 is lowered, the next ring R2 is formed as shown in FIG. 4. A second reinforcing cage 221, 222 is erected with the lower ends of the reinforcing bars secured to the upper ends 21U and 22U of the initial annular reinforcing cage and a second pipe section 226 is fastened to the coupling 27 of the first annular ring R1. Jacks are again applied (not shown in FIG. 4) and the pumping of water and the material of the backfill washing out by means of alternate pipes 26 is resumed. The construction of the annular rings R1, R2, R3 . . . RN continues to the final design depth. When the structure has reached its design depth, the pipes 26 can be used as grout pipes to extend a drill curtain below the bottom of the trench T. The joint J between each annular ring section can be specially fabricated to be absolutely water tight because the joint is fabricated above ground and is exposed when the forms of the upper ring section R2 are removed and prior to the erosion of the backfill in the Trench T. Of course, since the wall segments are above ground, they can be coated with further waterproofing materials, such as bituminous or tar compounds, etc. The grouting can fill any contact space between the structure and rock and the grout can fill any void left around the structure by the washing of the backfill.

In FIGS. 2 and 4, the water pump and the means for removing the water carrying eroded backfill, respectively, are diagramatically illustrated.

Thus, there has been disclosed and described a method and apparatus for constructing underground concrete wall, particularly hollow circular shafts in grounds where a conventional slurry wall would be irregular and possibly misaligned and in the presence of a high water table. It allows continuity of horizontal reinforcement in the shaft which is a definite advantage under certain design conditions.

While there has been disclosed and described a preferred embodiment of the invention, it will be appreciated that various modifications and adaptations of the basic underlying philosophy of the invention without departing from the spirit thereof and it is intended that such modifications, departures and adaptations be incorporated in the claims appended hereto.

What is claimed is:

1. A method of constructing a reinforced concrete wall in the ground comprising:

I. forming a pair of concrete guide walls spaced apart along the line of said wall, the spacing between said guide walls being greater than the width of the reinforced concrete walls to be constructed, II. excavating a trench between said pair of guide walls and backfilling said trench with an erodable mixture capable of sustaining the excavation walls, said erodable backfill materials having no large aggregates, III. placing forms along said wall and above the surface of said trench and spaced apart the width of said reinforced concrete walls, installing steel reinforcement between said forms and casting concrete between said forms from the surface of said erodable mixture and filling said forms to thereby form an initial concrete wall section, IV. after the concrete has set in said initial concrete wall section, injecting a fluid material below said initial concrete wall section to erode said backfill and removing the eroded backfill material and injected fluid from below said concrete wall section, lowering said initial concrete wall section into the trench while eroding said erodable backfill materials, said initial concrete wall section being lowered to a level wherein a portion thereof projects above the ground, V. forming at least one further wall section directly on said first wall section by placing forms therealong, and VI. after the concrete has set in said at least one further concrete section, lowering the said sections while eroding said backfill material below said initial concrete section to the bottom of said trench.

2. The invention defined in claim 1, wherein the steel reinforcement in said first section is coupled to the steel reinforcement in said at least one further concrete section.

3. The invention defined in claim 1, including placing a series of vertical pipes in said initial concrete wall section and coupling said series of vertical pipes in said initial concrete wall section with a like series of aligned pipes in said at least one further wall section wherein step IV includes injecting water into selected ones of said vertical pipes and withdrawing injected water and eroded backfill material from selected others of said vertical pipes.

4. The invention defined in claim 1, including forming a groove in the upper surface of said first wall section so as to form a locking seal with said at least one further concrete section.

5. The invention defined in claim 3, wherein step IV includes injecting water into alternate ones of said vertical pipes and withdrawing water and eroded backfill from at least some of the remaining vertical pipes.

6. The invention defined in claim 3, including:

VII. injecting a grout below the lower most concrete wall section through all said vertical pipes.

7. The invention defined in claim 1 wherein said erodable backfill materials are selected from the group comprising cement-bentonite and sand-cement-bentonite.

8. Apparatus for constructing a reinforced concrete wall in the earth comprising a first plurality of substantially vertical pipes, concrete wall forming means in which said pipes are embedded, said concrete wall forming means being positioned over a trench in the earth filled with an erodable backfill material, a second plurality of substantially vertical pipes embedded in said concrete wall forming means, water supply means connected to said first plurality of pipes for introducing water therein to erode said erodable backfill material, and means connected to said second plurality of pipes for removing water and eroded backfill material from said trench.

9. Apparatus as defined in claim 8, including a pair of spaced apart guide means defining said trench and jack means between said guide means and said concrete walls for lowering said concrete wall into said trench as said backfill is eroded by said water.

* * * * *